United States Patent [19]

Richard W. Hansen

[11] Patent Number: 4,796,820

[45] **Date of Patent: * Jan. 10, 1989**

[54] PORTABLE ROCK CRUSHER

[76] Inventor: Richard W. Hansen, 1027 Crestwood, Meridian, Id. 83642

[ * ] Notice: The portion of the term of this patent subsequent to Mar. 10, 2004 has been disclaimed.

[21] Appl. No.: 764,389

[22] Filed: Aug. 12, 1985

[51] Int. Cl.[4] ..... B02C 13/284; B02C 13/288

[52] U.S. Cl. ..... 241/69; 241/79.1; 241/101.1; 241/159 R; 241/193; 241/169.1

[58] Field of Search ..... 83/788, 790, 793; 30/381, 382; 241/169.1, 69, 101.1, 189 R, 193, 194, 195, 79.1, 186 R, 82.1; 144/1 R

[56] References Cited

U.S. PATENT DOCUMENTS

| | | | |
|---|---|---|---|
| 1,703,956 | 3/1929 | Royer | 241/193 X |
| 2,525,023 | 10/1950 | Ensminger | 241/193 X |
| 2,821,216 | 1/1958 | West et al. | 144/1 R |
| 3,342,426 | 9/1967 | Sackett, Sr. | 241/189 R |
| 3,929,293 | 12/1975 | Hahn et al. | 241/189 R |
| 4,417,593 | 11/1983 | Brehon | 241/169.1 X |

FOREIGN PATENT DOCUMENTS

| | | | |
|---|---|---|---|
| 556614 | 4/1957 | Belgium | 241/169.1 |
| 1219297 | 12/1959 | France | 241/82.1 |
| 880471 | 11/1981 | U.S.S.R. | 241/186 R |

*Primary Examiner*—Mark Rosenbaum
*Attorney, Agent, or Firm*—B. Deon Criddle

[57] ABSTRACT

A portable material pulverizer using chain links as flails to break up rock samples contained within the housing of the pulverizer is adapted to be fitted onto the frame and motor apparatus of a conventional chain saw or other hand carried drive structure, that drives the flails to crush and pulverize the materials placed in the housing.

12 Claims, 4 Drawing Sheets

PORTABLE ROCK CRUSHER

BACKGROUND OF THE INVENTION

1. Field of the Invention

The present invention pertains to crushers for rock and other materials and particularly to portable crushers that will effectively pulverize materials placed thereon.

2. Prior Art

A wide variety of crushers have been proposed in the past. Many of these crushers have special applications in the mining industry. Generally the devices are physically large and quite expensive and it is usually necessary to bring rock to be crushed to the machine.

Field geologists frequently need to have even small rock samples analyzed so they often send such samples to a laboratory capable of making such anaylsis. The rock must be crushed to be properly analyzed and the laboratory generally charges an extra fee if the crushing is accomplished at the laboratory. Also, shipping charges can be reduced if the rock is pulverized before shipping. Consequently it is desirable that the field geologist have access to a rock crusher in the field so that rock to be analyzed can be immediately crushed. This, then may result in significant cost savings to the geologist.

Others also have need for crushers and pulverizers that are adaptable to either large scale or smaller portable sizing. For example there is a continuing need throughout the world for such devices to crush grains.

A number of crushers proposed in the past have used motor driven rotors with swinging hammers inside housing to break up and crush rock placed in the housing. Such crushers are shown, for example, in U.S Pat. Nos. 1,013,527, 1,424,922, 1,490,368, 1,666,124, 1,721,821, 1,733,637 and 2,169,684. The crushers shown in the foregoing patents disclose the use of a variety of swinging elements. Other arrangements of flail type swing elements and means for attaching them to rotors or drums are shown in U.S. Pat. Nos. 1,687,093, 2,573,227 and 3,608,842 and U.S. Pat. Nos., 4,172,481 and 4,222,418 show lengths of chain used as flails mounted to rotatable drums.

U.S. Pat. Nos. 2,783,794 and 4,227,840 teach the use of a Chain Saw Frame and Drive Assembly to support and drive rotatable tools for drilling and U.S Pat. No. 2,821,216 teaches chain flails attached to a chain saw blade for use in clearing vegetation. The present invention comprises a crusher or pulverizer that may be attached to a conventional chain saw and frame and that uses the motor and drive apparatus of the chain saw to drive the unit as a crusher or pulverizer. The device is simple to handle and provides an inexpensive, hand held, portable material crusher that is readily available to geologists and others in need of such equipment. It has also been found that the apparatus of the invention can be readily constructed in diverse sizes to handle desired volumes of material and that a wide variety of materials can be crushed or pulverized. Thus, while the present invention is ideally suited for use as a relatively small unit, that can be attached to a power unit, such as a drive unit of a chain saw it can also be made larger and having its own power unit.

To the best of my knowledge, however, there has not heretofore been known an inexpensive, easily used and repaired crusher that is readily adaptable for use on a larger scale and capable of handling a large range of materials while still being adapted for use with a hand held drive unit. Neither has heretofore been a unit incorporating a wind tunnel through which crushed material is moved over a sizing screen through which material crushed to size will pass.

OBJECTS OF THE INVENTION

A principal object of the present invention is to provide a portable material crusher.

Another object of the present invention is to provide a portable material crusher that is light in weight.

Yet another object of the present invention is to provide a portable material crusher that is easy to handle and operate.

Still another object of the present invention is to provide a portable material crusher that is inexpensive.

Other objects are to provide a material crusher that will fully pulverize materials such as rock, metal, glass, grain, etc. placed therein; that includes easily replaced crushing components; that is adaptable to use with hand carried motor drives and frame assemblies such as are common to hand held chain saws; and that will effectively screen out materials crushed to desired size.

PRINCIPAL FEATURES OF THE INVENTION

Principal features of the present invention include a housing containing a pulley-wheel driven rotor having attached links of chain that are aligned to impact upon pieces of rock or other material fed into the housing. The pulley-wheel is driven and the entire invention may be adapted to fit on a conventional chain saw frame so that the links are driven by the chain saw drive unit. The cutting chain and chain guide are removed from a chain saw frame when the chain saw drive unit is used and are replaced with the pulverizer of the present invention.

Other objects and features of the invention will become apparent from the following detailed description and drawing disclosing what is presently contemplated as being the best mode of the invention.

THE DRAWINGS

In the Drawings:

FIG. 1 is a side elevation view of a pulverizer on the invention, attached to a chain saw drive unit;

FIG. 2, a vertical section taken on the line 2—2 of FIG. 1;

FIG. 3, a plan view looking into one piece of the housing of the pulverizer;

FIG. 4, a view like that of FIG. 3, but looking into the other piece of the housing of the pulverizer;

FIG. 5, a side elevation view of the pulverizer of the invention and including a wind tunnel classification system;

FIG. 6, a view like that of FIG. 5, but with the housing cover partially broken away and the wind tunnel shown in section; and FIG. 7, a vertical section taken on the line 1–4 of FIG. 6.

DETAILED DESCRIPTION

Figure 1:
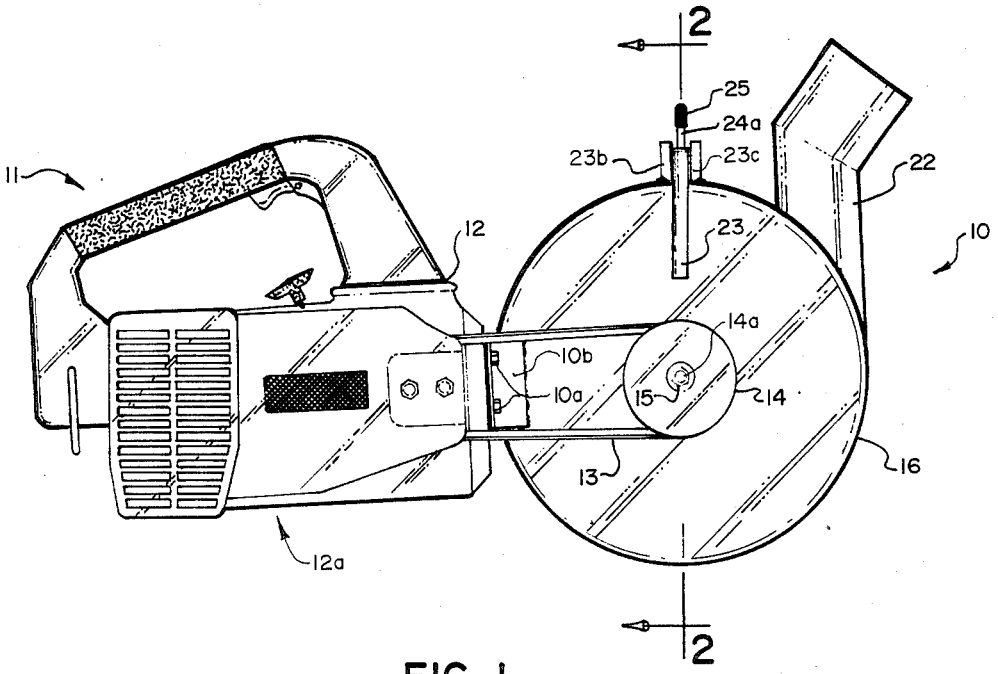
Figure 2:
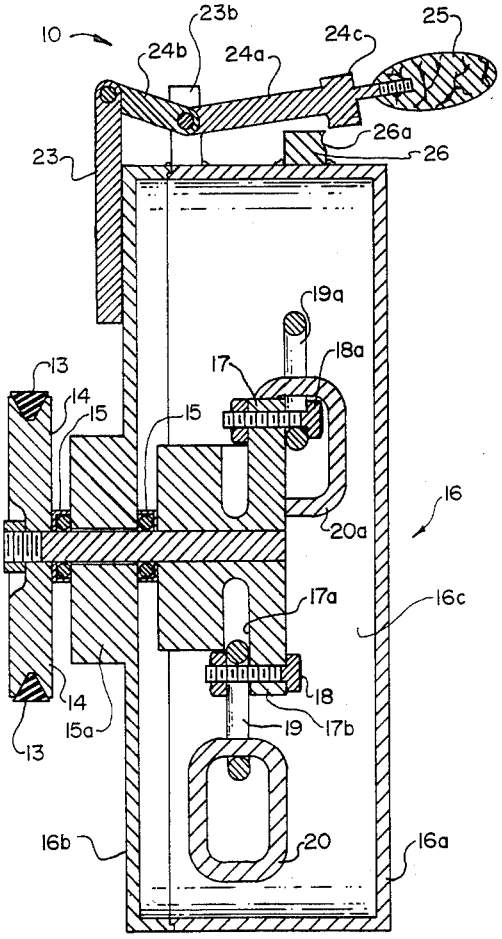
Figure 3:
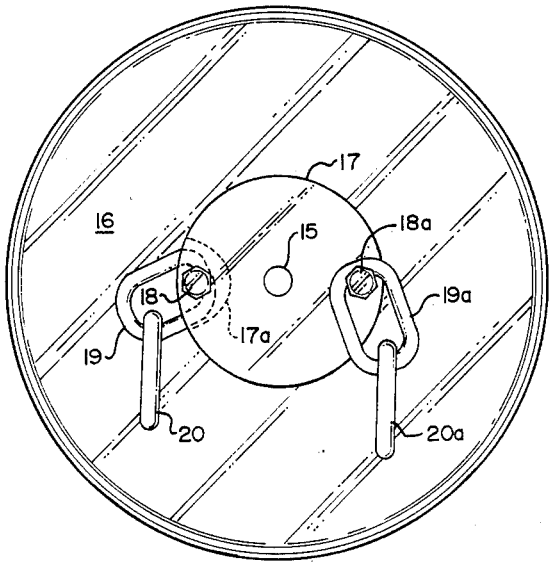
Figure 4:
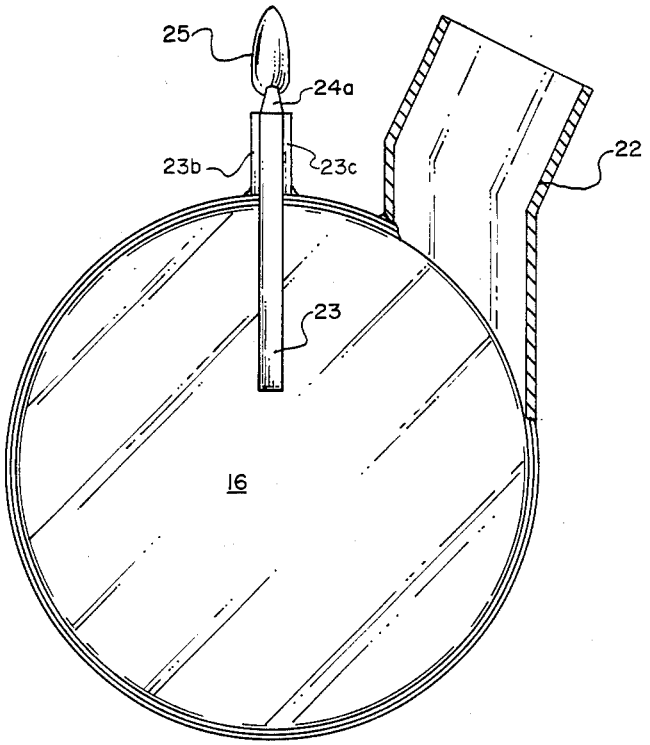

Referring now to the drawing:

In the illustrated preferred embodiment of FIG. 1–3 the material pulverizer of the invention is shown generally at 10. As shown in FIG. 1, the pulverizer 10 is attached to a conventional chain saw assembly 11 having a frame 12 and motor and drive assembly 12*a*. The usual cutting chain and chain guide have been removed and replaced with the pulverizer 10 attached by bolts 10*a* inserted through a bracket 10*b* of the pulverizer to frame 12*a* so that the pulverizer will be driven by a belt 13, as will be further explained.

The crusher 10 includes a drive pulley wheel 14 mounted on a shaft 14*a* that is journaled through bearings 15, at opposite sides of a mounting block 15*a* in a wall of a housing 16 made up an interconnected first hanging part 16*a* and a second housing part 16*b* having a crushing chamber 16*c* formed therebetween. A rotor 17 is connected to the other end of the shaft 14*a* in the housing by welding or in any other suitable conventional manner.

Rotor 17 is notched at 17*a* at one side and has an enlarged outerface 17*b* to accommodate bolts 18 and 18*a* that are used to secure chain links 19 and 19*a*. Link 19 is held by bolt 18 and 18*a* and its associated nut associated during turning of rotor 17 and link 19*a* is held by bolt 18*a* and its associated nut. Links 20 and 20*a* are coupled to links 19 and 19*a*, respectively, and serve as flails during turning of rotor 17 to pulverize any material within the housing The belt 13 is passed around a drive spocket of the chamber and around pulley 14 to drive the rotor.

When the chain saw is operated centrifugal force swings the links 20 and 20*a* out to continuously impact upon rock fed into the crushing chamber 16*c* through a chute 22 extending upwardly from housing part 16*a*.

The housing parts 16*a* and 16*b* are held together by a conventional lamp assembly In the embodiment shown an over-center clamp 23 includes a pivot bar 23*a* and spaced brackets 23*b* and 23*c* on housing art 16*a* and pivotally connected links 24 and 24*b*. Link 24 is also pivotally connected to pivot bar 23. The brackets 23*b* and 23*c* guide the pivot connection between links as handle 25 is depressed to catch a hook on link 24*a* with a lip 26*a* on an ear 26, fixed to the top of housing part 16*b*. Other conventional latches could as well be used.

In the embodiment of FIG. 1–4 links 19, 19*a*, 20 and 20*a* are conventional chain links. The components are thus inexpensive and replacement parts are readily available. In addition, the bolts 18 and 18*a* and their associated nuts are also easily replaced and are readily available commercially. Consequently, the major wear components are readily repaired or replaced, without need for expensive servicing.

Figure 5:
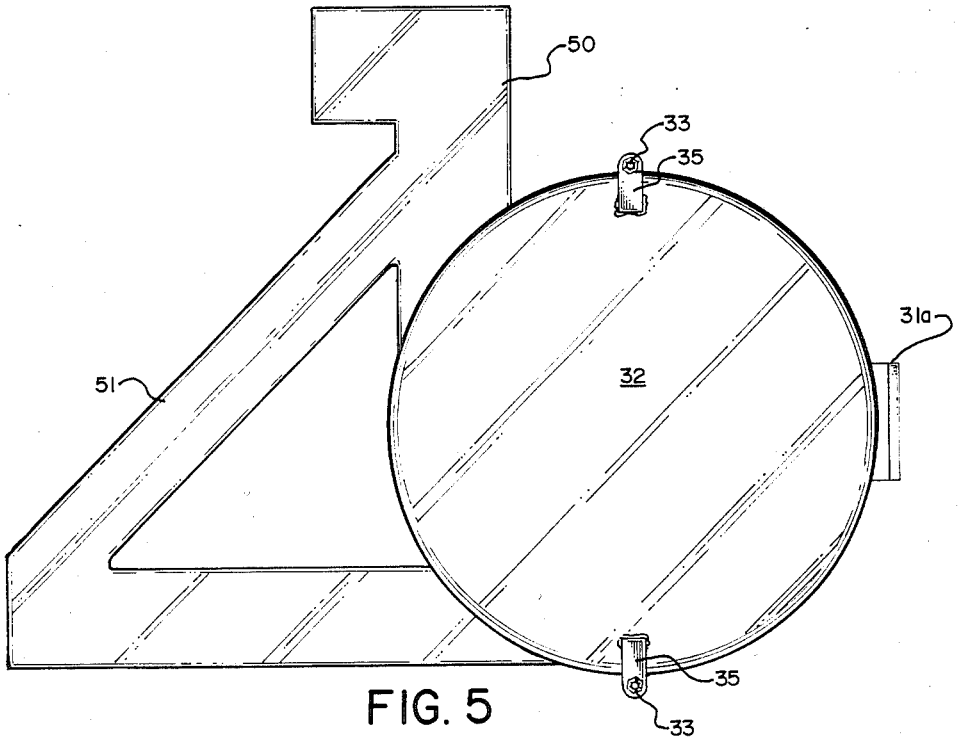
Figure 6:
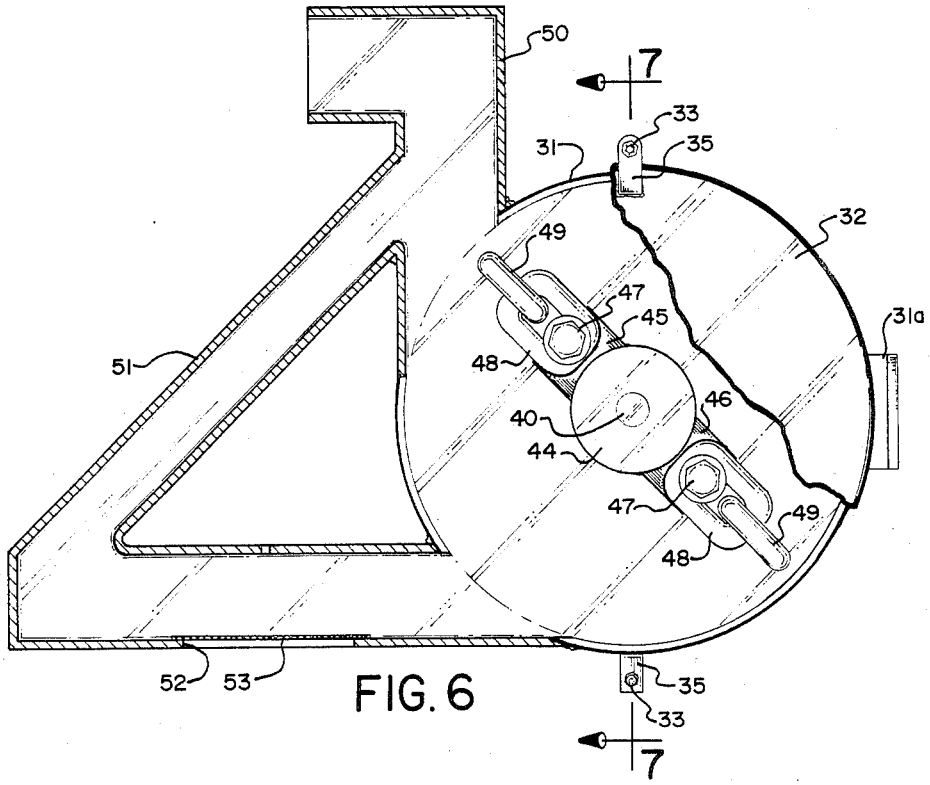
Figure 7:
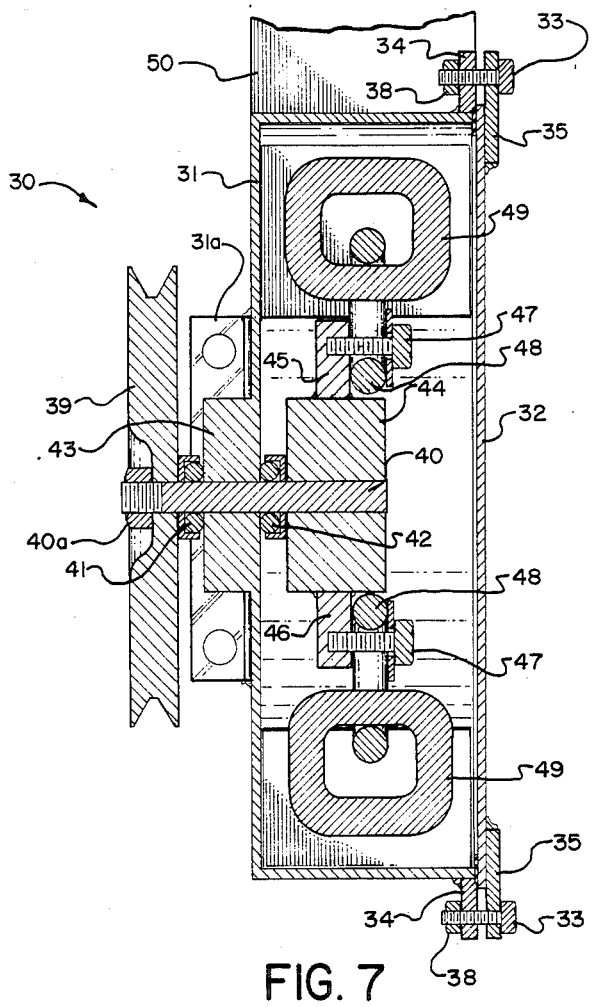

In the embodiment of the invention shown in FIG. 5–7, the material pulverizer of the invention is shown generally at 30, adapted to be connected to a chain saw frame and to be driven by a chain saw drive assembly in the same manner previously described with reference to the embodiment of FIG. 1–4.

In this embodiment the pulverizer includes a first housing part 31 with an attached bracket 31*a* to which a chain saw frame is to be bolted and a cover plate 32 that closes the housing part 31 for form a crushing chamber 31*a*. Bolts 33 are inserted through matching ears 34 and 35 projecting from the housing part 31 and cover plate 32, respectively, and nuts 38 are threaded thereon.

A pulley 39 is fixed to a rotor shaft 40 by a nut 40*a* threaded onto the end of the shaft outside housing part 31 and the shaft extends through bearings 41 and 42 and a boss 43 into the housing part. A rotor 44 is fixed to the other end of rotor shaft 40, inside the housing part 31 and ears 45 and 46 project from opposite sides of the rotor.

A bolt 47 passes through a chain link 48 and is threaded into each ear 45 and 46 and a similar chain link 49 is connected to each link 48 so that the links 48 and 49 serve as flails, as will be further explained.

A chute 50 extends upwardly and outwardly from the periphery of the housing part 31 and opens tangentially into the crushing chamber 31*a* so that material to be crushed and pulverized can be fed therethrough into the crushing chamber.

One end of wind tunnel 51 opens into the chute 50 near the connection of the chute with the housing part 31. The wind tunnel then extends downwardly and outwardly therefrom and then back to connect with the housing part 31 and to open tangentially into the crushing chamber 31*a*. An opening 52 is provided in the wind tunnel 51 at a bottom thereof, rear the location at which the tunnel connects to the housing part 31, and the opening is covered by a screen 53.

As in the previously described embodiment when the pulverizer 30 is attached to a power unit, such as the frame and drive assembly of a chain saw, pulley 30 is turned. This turns rotor 44 and the chain links become flails- within the crushing chamber. The flails rotate in a counter-clockwise direction as viewed in FIG. 6 and as they turn they create a wind pressure in the chamber. Some of the wind thus created, together with material fines through the tunnel from the top thereof. As the fines move across screen 53 they fall therethrough to be collected in a receiving vessel, not shown.

Vibrations set up in the housing by engagement of the chain links with material being crushed helps to vibrate fines through the screen 53.

The size of mesh openings in the screen 53 will determine the maximum size of the particle and it will be apparent that a series of screens of different mesh size can be placed along the tunnel to obtain classification of particles, if desired.

While not always necessary, or desired, one or more openings 55 may be provided through an upper wall of the tunnel, above the area of screen 53 or any other screen provided. The opening(s) 55 may also be provided with closure means to vary the opening sizes. If used, the opening(s) 55 permit ambient air to be introduced at the screens, thus somewhat reducing the velocity of wind flow over the screens and enhancing fall out of particles into and through the screens.

The pulverizers or crushers described are adaptable to use in the grinding of diverse materials. They have been found very suitable in the reduction of rock, glass, grains, aluminum cans and other materials.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A portable pulverizer comprising a housing including a first housing portion and a second housing portion;

means releasably clamping the second housing portion to the first housing portion; to provide a crushing chamber therein;

a chute opening into the crushing chamber, whereby material crushed is fed into the crushing chamber through the chute;

a shaft journaled through the first housing portion;

a pulley on the shaft outside the crushing chamber;

flail means fixed to and rotatable with the shaft in the crushing chamber;

a chain saw frame and drive means; and means coupling the drive means of the chain saw to the pulley to drive the shaft and the flail means, whereby operation of the drive means will turn the flail means in the crushing chamber to crush material placed in the housing.

2. A pulverizer as in claim 1, wherein a rotor is fixed to the shaft in the crushing chamber; and the flail means comprises at least two sets of pairs of interconnected chain links, respectively connected to opposite sides of the said rotor.

3. A pulverizer as in claim 2, wherein the means coupling the drive means of the chain saw to the pulley comprises a flexible belt.

4. A pulverizer as in claim 1, further including a wind tunnel having one end connected into the crushing chamber at an upper portion thereof, and its other end connected into a lower portion of the crushing chamber; and at least one screen in a bottom of the wind tunnel through which crushed material is discharged.

5. A material pulverizer as in claim 4, wherein one end of the wind tunnel is connected into the chute.

6. A material pulverizer as in claim 5, further including at least one opening through a wall of the wind chute opposite the screen.

7. A material pulverizer as in claim 4, further including at least one opening through a wall of the wind chute opposite the screen.

8. A material pulverizer comprising a housing including a first housing portion and a second housing portion;

means releasably clamping the second housing portion to the first housing portion to provide a generally circular crushing chamber therein;

an inlet chute opening into the crushing chamber at an upper portion of the housing;

a wind tunnel having an intake end connected into the crushing chamber at the upper portion thereof, and a discharge end connected into the lower portion of the crushing chamber;

at least one screen in a bottom of the wind tunnel through which crushed material is discharged;

a shaft journaled through the first housing portion;

a pulley on the shaft outside the crushing chamber;

flail means fixed to and rotatable with the shaft in the crushing chamber;

a drive means; and means coupling the drive means to the pulley to drive the shaft and the flail means, in a direction so that the drive means will turn the flail means in the crushing chamber to crush material placed in the housing and to create a wind in the said housing and moving through the tunnel from the intake end to the discharge end.

9. A pulverizer as in claim 8, wherein a rotor is fixed to the shaft in the crushing chamber; and the flail means comprises at least two sets of pairs of interconnected chain links, respectively connected to opposite sides of the said rotor.

10. A material pulverizer as in claim 9, further including at least one opening through a wall of the wind tunnel opposite at least one screen.

11. A material pulverizer as in claim 8, wherein the inlet end of the wind tunnel is connected into the inlet chute.

12. A material pulverizer as in claim 8, wherein a screen covers at least one opening in a bottom of the wind tunnel.

* * * * *